US012753453B2

(12) United States Patent
Wagner et al.

(10) Patent No.: US 12,753,453 B2
(45) **Date of Patent: *Oct. 6, 2026**

(54) WORKPIECE HOLDING DEVICE

(71) Applicant: AKTIEBOLAGET SKF, Gothenburg (SE)

(72) Inventors: Gerhard Wagner, Prichsenstadt (DE); Fred Menig, Sulzthal (DE); Martina Sticht, Sennfeld (DE); Michael Wendel, Bremen (DE)

(73) Assignee: AKTIEBOLAGET SKF, Gothenburg (SE)

( * ) Notice: Subject to any disclaimer, the term of this patent is extended or adjusted under 35 U.S.C. 154(b) by 635 days.

This patent is subject to a terminal disclaimer.

(21) Appl. No.: 18/117,609

(22) Filed: Mar. 6, 2023

(65) Prior Publication Data

US 2023/0287533 A1 Sep. 14, 2023

(30) Foreign Application Priority Data

Mar. 11, 2022 (DE) ..... 102022202467.2

(51) Int. Cl.
*C21D 9/00* (2006.01)
*C21D 11/00* (2006.01)
(Continued)

(52) U.S. Cl.
CPC ..... *C21D 9/0025* (2013.01); *C21D 9/0037* (2013.01); *C21D 11/00* (2013.01); *C21D 1/18* (2013.01); *C21D 9/40* (2013.01)

(58) Field of Classification Search
CPC .... C21D 9/0025; C21D 9/0037; C21D 11/00; C21D 1/18; C21D 9/40; C21D 9/0018; C21D 1/00; C21D 1/62; B25B 11/00
(Continued)

(56) References Cited

U.S. PATENT DOCUMENTS 2,723,861 A 11/1955 Eisler
2,919,925 A 1/1960 Snyder et al.
(Continued)

FOREIGN PATENT DOCUMENTS

CN 114042947 A 2/2022
DE 102018212771 A1 2/2020
(Continued)

OTHER PUBLICATIONS

Office Action from the United States Patent Office mailed Nov. 26, 2025 in related U.S. Appl. No. 18/117,595.
(Continued)

*Primary Examiner* — Jessee R Roe
*Assistant Examiner* — Michael Aboagye
(74) *Attorney, Agent, or Firm* — J-TEK LAW PLLC; Scott T. Wakeman; Mark A. Ussai

(57) ABSTRACT

A workpiece holding device for holding a workpiece having a substantially radial inner surface and a substantially radial outer surface in a heat treatment system while the workpiece undergoes a thermal expansion and/or contraction, the workpiece holding device includes at least two clamping units configured to apply a radial clamping force to the workpiece to hold the workpiece in the workpiece holding device in a predefined position, each of the at least two clamping units including a clamping element configured to abut against the radially inner surface and/or against the radially outer surface of the workpiece and to apply a radial clamping force to the workpiece.

18 Claims, 10 Drawing Sheets

(51) Int. Cl.
*C21D 1/18* (2006.01)
*C21D 9/40* (2006.01)

(58) Field of Classification Search
USPC ..... 266/44, 274
See application file for complete search history.

(56) References Cited

U.S. PATENT DOCUMENTS

| | | | | |
|---|---|---|---|---|
| 3,023,016 | A | 2/1962 | Multer et al. | |
| 3,041,079 | A | 6/1962 | Garrison et al. | |
| 3,716,224 | A | 2/1973 | Gross | |
| 3,727,772 | A * | 4/1973 | Pauls | B25B 1/18 414/745.7 |
| 3,850,058 | A | 11/1974 | Bachmann | |
| 3,945,654 | A | 3/1976 | McMullen | |
| 3,985,051 | A | 10/1976 | Brown | |
| 4,459,451 | A * | 7/1984 | Regele | H05B 6/40 219/652 |
| 4,530,507 | A | 7/1985 | Lee, Jr. | |
| 4,576,067 | A | 3/1986 | Buck | |
| 4,701,584 | A | 10/1987 | Rylicki | |
| 4,838,562 | A | 6/1989 | Akashi | |
| 4,998,663 | A | 3/1991 | Cakmak et al. | |
| 5,234,201 | A | 8/1993 | Chatterjee et al. | |
| 5,685,996 | A | 11/1997 | Ricci | |
| 6,568,694 | B1 | 5/2003 | White | |
| 6,612,589 | B2 | 9/2003 | Saito | |
| 6,918,278 | B2 | 7/2005 | Dole et al. | |
| 8,993,942 | B2 | 3/2015 | Fitch et al. | |
| 9,169,529 | B2 | 10/2015 | Johnson et al. | |
| 9,802,269 | B2 | 10/2017 | Rudolph et al. | |
| 10,940,548 | B2 | 3/2021 | Ibarra Garcés et al. | |
| 11,027,381 | B2 | 6/2021 | Onushko et al. | |
| 11,154,938 | B2 * | 10/2021 | Maurer | B23B 31/142 |
| 11,465,230 | B2 | 10/2022 | Nakaya et al. | |
| 11,707,797 | B2 | 7/2023 | Kitakaze | |
| 2001/0001935 | A1 | 5/2001 | Wilk, Jr. et al. | |
| 2004/0206218 | A1 | 10/2004 | Nybo | |
| 2023/0286061 | A1 | 9/2023 | Wagner et al. | |
| 2023/0286062 | A1 | 9/2023 | Wagner et al. | |
| 2023/0286063 | A1 | 9/2023 | Wagner et al. | |
| 2023/0287532 | A1 | 9/2023 | Wagner et al. | |

FOREIGN PATENT DOCUMENTS

| | | | | |
|---|---|---|---|---|
| DE | 102018212773 | A1 | 2/2020 | |
| DE | 102018212778 | A1 | 2/2020 | |
| EP | 0899061 | A2 | 3/1999 | |
| EP | 102018212778 | * | 2/2020 | C21D 9/0025 |
| SU | 1480973 | A1 | 5/1989 | |
| WO | 2012101319 | A1 | 8/2012 | |

OTHER PUBLICATIONS

Office Action from the United States Patent Office mailed Dec. 16, 2025 in related U.S. Appl. No. 18/117,600.

Office Action from the United States Patent Office mailed Feb. 25, 2026 in related U.S. Appl. No. 18/117,607.

Office Action from the United States Patent Office mailed Oct. 9, 2025 in related U.S. Appl. No. 18/117,614.

* cited by examiner

WORKPIECE HOLDING DEVICE

CROSS-REFERENCE

This application claims priority to German patent application no. 10 2022 202 467.2 filed on Mar. 11, 2022, the contents of which are fully incorporated herein by reference.

TECHNOLOGICAL FIELD

The present disclosure is directed to a workpiece holding device for holding a workpiece in a heat-treatment system, wherein due to a heat treatment the workpiece experiences a thermal expansion and/or contraction or an expansion and/or contraction due to a density difference arising in the microstructure during the phase transformation.

BACKGROUND

In order to treat workpieces thermally, for example to heat or quench them, the workpieces must be arranged securely and in a precise position relative to the treatment system in order to achieve very precise heat input and subsequently defined quenching processes of the treatment zones. For this purpose conventional clamping means can be used, such as, for example, so-called three- or four-jaw chucks that include three or four clamping jaws that are mounted on a workbench and grouped circumferentially around the tool to be held. In these clamping jaws, prior to the treatment of the workpiece, the workpiece is clamped and held, wherein a repositioning of the clamping jaws is possible in order to compensate for a thermal contraction and/or expansion or a contraction and/or expansion due to a density difference arising in the microstructure during the phase transformation. Furthermore, it is known with such devices to move the entire work table, together with the clamping jaws, past fixed heat sources in order to simplify the repositioning of the supply lines needed for the heat sources.

However, it is disadvantageous in this device that due to the thermal expansion or contraction or an expansion or contraction due to a density difference arising in the microstructure during the phase transformation to be compensated for, the force that is needed for the repositioning of the jaws may be chosen too low, and it can then nonetheless result that the jaws no longer abut against the workpiece and thus cannot sufficiently fix it, or a too-high force of the jaws may lead to a deformation of the workpiece.

Furthermore, with the known devices it is problematic that the large mass to be moved comprised of workbench, clamping jaws, and workpiece leads to very high wear in the drive system of the work table so that its components must often be replaced or the drive must be completely exchanged. Also, due to the large mass to be moved and the dimensions of the device, overall limits are set for the process parameters, such as for example, a relative speed between inductor and workpiece, with the result that an optimized heat input into the workpiece cannot always be achieved.

However, the heat input and the distribution of the heat input in the workpiece are of enormous importance in order to achieve the desired workpiece properties in the treatment zones and to control the resulting dimensional and shape changes (workpiece warpage). Known possibilities for influencing the heat input and the temperature distribution in the case of the example of an inductive hardening are a suitable choice of the process parameters or of the process design (electrical power, heating time, heating frequency, inductor-workpiece coupling distance, inductor material, inductor design, targeted use of magnetic field concentrators, workpiece material, previous condition of the workpiece material, relative speed of the workpiece with respect to the inductor, etc.)

SUMMARY

The workpiece holding device is therefore a decisive element of the heat-treatment system and of the success of the heat treatment. It is therefore the object of the present invention to provide a workpiece holding device, in particular a workpiece clamping system, that fulfills the following functions, preferably holistically:

- Ensure a predefined inductor-workpiece coupling distance;
- Position the workpiece in a defined position;
- Hold the workpiece in a defined position against the acting forces (e.g., magnetic fields) during the entire process time;
- Ensure good reproducibility of the heat treatment;
- Allow the heat treatment at all positions of the workpiece (inside, outside, side surfaces above and below);
- Avoid crack formation.

In the following, a workpiece holding device is presented for holding a workpiece in a heat-treatment system, wherein the workpiece held in the workpiece holding device experiences a thermal expansion and/or contraction or an expansion and/or contraction due to a density difference arising in the microstructure during the phase transformation. In the following, only thermal expansion or contraction is discussed, since even with a phase transformation a thermal component is usually present. Furthermore, the workpiece holding device includes at least two clamping units that are designed to apply a radial and/or axial clamping force onto the workpiece so that the workpiece is positioned in the workpiece holding device in a predefined position. Furthermore, the workpiece is a closed curve and has an substantially radial inner surface and an substantially radial outer surface. The workpiece is preferably designed rotationally symmetric, such as, for example, an element of a plain or rolling-element bearing, a bearing ring, a gear, a bolt, a sleeve, a disc, etc.

In order to reduce the wear of the components of the workpiece holding device, in particular due to high mass, and simultaneously to optimize the heat input into the workpiece, the workpiece held in the workpiece holding device is supported rotatably about a rotational axis. Since only the workpiece, but not the entire unit comprised of workpiece, workbench, clamping units, and further equipment must be set into motion, but rather only the workpiece, even with large workpieces a large weight reduction can be achieved of the parts to be set in motion. This in turn also allows, in addition to the lower loading of the components, and thus also lower wear of the components of a drive system, a more precise setting of the process parameters, such as, for example, the rotational speed, and thus an improved heat input into the workpiece. Furthermore, less energy need be expended in order to set the workpiece in rotation than with the conventional systems so that a cost reduction is also thereby possible.

However, in order that in such embodiment a particularly uniform clamping force is exerted on the workpiece, and the workpiece can be secured in its position in positionally accurate manner, clamping units are provided that each include at least one clamping element that is designed to abut against a radially inner surface and/or radially outer surface of the workpiece and to apply a radial clamping force onto the workpiece.

Furthermore, according to one preferred exemplary embodiment, at least one drive unit is provided that is configured to move the workpiece held in the workpiece holding device, in particular to set it in rotation, wherein preferably the at least one drive unit is configured as friction wheel or friction roller and is configured to abut against the workpiece with a certain friction force and interact in a friction-fit manner with the workpiece in order to move it. A particularly simple and cost-effective drive can thus be provided for the workpiece.

It is advantageous in particular here when the friction force applied between drive unit and workpiece is defined by a contact force between drive unit and workpiece. It can thereby be ensured that even with thermal contraction or expansion of the component an optimized drive of the workpiece is provided. Here it is advantageous in particular when a measuring device, for example, a pressure sensor, that determines the contact force is provided on the drive unit. An embodiment is also advantageous here in which, based on the measured contact force, a controller can control the contact force such that the contact force and thus the friction force is optimized. It can thereby be ensured that even with thermal expansion or contraction, or with structural asymmetries, such as, for example, an imbalance, the workpiece is nevertheless always driven with a constant force. Damage due to high force on the workpiece is also avoided.

Furthermore, it can also thereby be ensured that a slippage between workpiece and drive unit is minimized. In addition, due to the specific contact force, wear between workpiece and drive unit can also be minimized. The workpiece warpage can also thereby be minimized and/or plastic workpiece deformations can be avoided or minimized. In addition, the defined friction force allows a precise setting of the rotational speed so that in particular it is possible to allow the workpiece to rotate with a defined speed.

According to a further preferred exemplary embodiment, the clamping element is configured as a slide shoe that preferably has an abutment surface abutting against the radially inner surface and/or radially outer surface, wherein the abutment surface preferably has a curvature that is adapted to a curvature of the radially inner surface and/or radially outer surface. Such a slide shoe allows a particularly precise guiding and simultaneous clamping of the component, wherein the clamping force is distributed over a relatively large surface. Such embodiments are advantageous in particular when any warpage during the heat treatment, even due to the clamping force effect, is to be avoided.

According to a further preferred exemplary embodiment, the clamping units each include at least one rotatable clamping element abutting against the workpiece; the rotational axis of the clamping element is preferably configured parallel to a rotational axis of the workpiece. Of course, a rotational axis inclined with respect to the rotational axis of the workpiece is also possible. Alternatively or additionally, the support units each include at least one rotatable support element against which the workpiece lies and whose rotational axis is preferably configured perpendicular to a rotational axis of the workpiece. Also alternatively or additionally, the rotational axis of the clamping element and/or of the support element can be oriented parallel to a surface of the workpiece to be rotated. For example, these rotatable elements can be moved along passively during moving of the workpiece and thus reduce friction during the moving of the workpiece.

According to a further preferred exemplary embodiment, instead of a line contact of the clamping element or of the support element, the clamping element or the support element can also contact the workpiece only in a point contact, which has the advantage of applying an axially directed force onto the workpiece. Thus for example, the workpiece can simultaneously be secured in its axial position by the driven clamping element/support element.

Unless explicitly indicated, in the following the term "rotatable element" refers both to clamping elements and to support elements.

Here the rotatable element can have a cylindrical, conical, convex, and/or spherical shape. The exact shape can depend on a plurality of factors. On one hand, the shape can be adapted to the shape or curvature of the radially inner or outer surface of the workpiece. Here it is preferred in particular that the rotating element contacts the workpiece along a line, wherein the line is oriented parallel to the rotational axis. This makes possible a pure rotational movement between the rotating element and the workpiece without sliding movement. However, it is equally possible to select the shape based on a minimal contact but sufficient clamping force. The shape can also be selected based on rotation considerations. Furthermore, it is possible that the clamping units include different rotatable elements.

According to a further preferred exemplary embodiment, the clamping elements can be releasably attached to the clamping unit. This makes possible a simple exchange or an adapting to various geometries of the workpiece to be treated.

Here it is preferred in particular when the clamping unit furthermore includes a journal onto which the rotatable element is slidable, wherein the rotatable element is preferably configured as a slide-on sleeve.

According to one further preferred exemplary embodiment, the clamping unit can furthermore comprise an adjusting device that is designed to set an angular position of the rotating clamping element. This also makes possible a particularly good adapting of the rotating elements to the geometry of the workpiece. Thus, with the aid of the adjusting device, it is possible, for example, to use a cylindrical rotatable element also for obliquely extending radial surfaces and still guide the rotating element along the workpiece with linear contact. Alternatively, a conical sleeve could also be used here.

According to a further preferred exemplary embodiment, the rotatable element is configured as a drive unit, in particular as a friction roller, that is configured to rotate the workpiece in the workpiece holder, wherein in particular a friction force applied between rotatable element and workpiece is defined by a contact force between rotatable element and workpiece. It is preferred in particular here when the rotatable element described above is actively rotationally driven. It is also possible that the rotatable element includes a friction surfacing or a friction coating that provides the active drive.

Here it is advantageous in particular when the friction force applied between the rotatable element and the workpiece is defined by a contact force between drive unit and the workpiece. It can thereby be ensured that, even with thermal contraction or expansion of the component, an optimized drive of the workpiece is provided. Here it is advantageous in particular when a measuring device, for example, a pressure sensor that determines the contact force, is provided on the rotatable element. An embodiment is also advantageous here in which, based on the measured contact force, a controller can control the clamping unit such that the contact force and thus the friction force is optimized. It can thereby be ensured that even with thermal expansion or contraction, or with structural asymmetries, such as, for example, an imbalance, the workpiece is nevertheless always driven with a constant force. Damage due to high force on the workpiece is also avoided.

Furthermore, it can also thereby be ensured that a slippage between workpiece and rotatable element is minimized. Due to the defined contact force, wear between workpiece and rotatable element can also be minimized. The workpiece warpage can also thereby be minimized and/or plastic workpiece deformations can be avoided or minimized. In addition, the defined friction force makes possible a precise setting of the rotational speed of the workpiece.

Since, as mentioned above, the clamping units each include at least one rotatable element abutting against the workpiece, this rotatable element can, however, be passively moved along in the same manner during movement of the workpiece, and thus reduce a friction during the moving of the workpiece.

According to a further preferred exemplary embodiment, the clamping element is furthermore designed to be preloaded toward the workpiece such that it abuts against the workpiece with a predetermined abutment force, wherein preferably the clamping element is furthermore configured to track the thermal expansion and/or contraction of the workpiece induced in the workpiece due to the heat treatment.

With the aid of the preload of the rotatable elements, the workpiece can be clamped with a defined force and defined force application points. In addition, due to the thermal contraction in the temperature range of the phase transformations ferrite/alpha iron to austenite/gamma iron (A1 temperature to A3 temperature, at approximately 700° C. to 1150° C. depending on steel, microstructural condition, and heating speed) and/or due to the subsequent cooling process, it can thereby be made possible to track a workpiece shrinkage or the reduced workpiece growth. At the same time, however, due to the rotatable elements, a workpiece growth or the reduced workpiece shrinkage due to the volume increase during the quenching in the range of the phase transformation from austenite/gamma iron to martensite and/or bainite/pearlite/ferrite (depending on the solution state and steel, this temperature range of the martensite formation can typically fall at approximately 400° C. to 100° C.) can also be tracked.

According to a further advantageous exemplary embodiment, the clamping of the rotatable element is effected by a mechanical preload element. Mechanical preload elements can be easily installed and do not require additional controlling, which overall makes the workpiece holding device easily operable and cost-effective.

Here the mechanical preload element can be at least one spring element that interacts with the rotatable element and preloads the rotatable element toward the workpiece. For example, the spring element can be a wire spring, a plate spring, coil spring, and/or leaf spring, but plastics can also be used, such as, for example, an elastomer.

Furthermore, it is possible that the mechanical preload of the rotatable element is formed by a friction device that makes possible a movement of the rotatable element only after exceeding of a certain friction value. Based on the pressure that an expanding/contracting workpiece exerts on the rotatable element during a thermal processing, a movement of the rotatable element may thereby only be effected after exceeding of a certain threshold value.

Instead of a mechanical preload device, the preload of the rotatable element can also be effected by a device that is controllable by a controller. Here the preload can be effected, for example, by a hydraulically, pneumatically or electrically operated element that tracks the thermal expansion/contraction. For example, the rotatable element can include an oil or gas operated pressure damper.

According to a further preferred exemplary embodiment, a controller is furthermore provided that controls the contact force and/or clamping force and/or friction force. Thus the controller can control, for example, the clamping force of the clamping unit, wherein preferably the controller is designed to control the movement of the rotating element, which movement applies the clamping force. Furthermore, for example, the clamping unit can include at least one measuring device for the recording of shape and dimensional changes during the heating process and after the conclusion of the heating process (warpage). The data recorded can also be used for subsequent processing procedures in order to undertake individual-workpiece adaptations to the processes.

In one preferred exemplary embodiment, at least one clamping unit, in particular the rotatable element, includes at least one force measuring device that interacts with the controller and is designed to measure the contact force with which the clamping unit, in particular the rotatable element, abuts against the workpiece. The force measuring device preferably interacts with the controller. The force measuring device also makes it possible to adapt to manufacturing inaccuracies when clamping the workpiece in the workpiece holding device so that a uniform pressure is already achieved at the various clamping units when the workpiece is clamped.

Alternatively or additionally, of course, the controller can also control the clamping unit, the support unit, and/or the drive unit based on a pre-calculated value table in order to be able to balance the calculated and expected expansions/contractions. Here the value table can be determined empirically and/or stored in a database that is accessible to the controller. This means the database can be stored internally in the controller itself or available in an external database.

In one preferred design, the controller can also additionally react to forces that act on the workpiece due to the processing system and increase or decrease a preload in a manner depending on measured forces or proactively. For example, in anticipation of electrical, mechanical or magnetic forces that temporarily act on the workpiece, the current preload can be increased or decreased by a preload value in a controlled manner. This temporary superposition of the preload regulated based on the thermal expansion with a controlled offset can preferably be turned on and off. Here also, the clamping unit, support unit, and/or drive unit can be controlled based on a value table in order to be able to reliably support and/or balance the calculated and expected forces on the workpiece. Furthermore, the controller can be designed such that it can be switched from a regulated operation, in which the preload forces are set based on measured values of the force measuring device, e.g., a load cell, to a controlled operation, in which the preload forces are set based on a value table, and can correspondingly be switched back from the controlled operation into the regulated operation. Thus it is possible, for example, during a thermal expansion to regulate the preload to the greatest possible extent, or completely, based on a predetermined preload pressure, and during a subsequent thermal contraction, such as, for example, rapid quenching, to increase the preload pressure to a fixed value.

Here the value table, or a setting of the clamping force, contact force, and/or friction force based on values of the value table, can depend in particular on measured and/or calculated temperature changes that are to be expected in the workpiece during the processing procedure.

According to a further advantageous exemplary embodiment, at least one of the clamping units is formed as an eccentrically supported clamping cylinder or slide shoe. The clamping cylinder and/or slide shoe can themselves be formed as movable or rotatable elements. However, alternatively or additionally it is also possible that they each include at least one further movable element. Furthermore, ribbings, or coatings made of, for example, friction particles, can advantageously be applied to the clamping cylinder; the ribbings or coatings facilitate the contact with the workpiece and ensure a movement/drive of the workpiece in the workpiece holding device.

According to a further preferred exemplary embodiment, the workpiece holding device furthermore includes at least two, preferably at least three, support units that are designed for the workpiece to lie against them. It can thereby be ensured on the one hand that the workpiece is supported in a tilt-free manner and on the other that the workpiece is movable easily and in a low-friction manner. Furthermore, one or more of the support units can also be formed as a drive unit.

Here it is preferred in particular when the support units each include at least one rotatable element against which the workpiece lies. This makes it possible that the rotatable elements are rotated as the workpiece move so that the friction is further reduced.

According to a further preferred exemplary embodiment, the rotatable element is releasably attachable to the support unit. In the event of damage, it can thereby easily be exchanged. Furthermore, it is preferred that, analogously to the rotatable element of the clamping units, the rotatable element of the support unit is also formed as a sleeve that has a straight or curved outer surface, in particular a cylindrical, conical, spherical and/or toroidal shape. The rotatable element of the support unit can thereby also be adapted to the specific geometry of the workpiece and can thus further reduce the friction. Here the sleeve can be formed as a slide-on sleeve that is easily exchangeable.

According to a further preferred exemplary embodiment, at least one of the clamping units and one of the support units are disposed on a common carrier. The number of components of the workpiece holding device can thereby be reduced. Furthermore, it is preferred that the rotatable elements of the clamping unit and support unit disposed on the common carrier are configured as combined rotatable element.

Alternatively or additionally, at least one of the support units can also be designed as a drive unit. Here also it is particularly preferred when the rotatable element described above is actively rotationally driven. In this case, the rotatable element can also be configured as friction wheel and/or friction roller that abuts axially and/or radially against the workpiece. It is also possible that the rotatable element only includes a friction surfacing or a friction coating that provides the active drive.

Furthermore, as already indicated above, an exemplary embodiment is preferred in which the rotatable element of the at least one clamping unit and/or support unit configured as drive unit is actively driven, wherein the at least one rotatable element of the clamping unit and/or support unit not configured as the drive unit is respectively set into rotation passively by the movement of the workpiece. This makes possible a particularly low-friction and energy-saving movement of the workpiece.

According to a further preferred exemplary embodiment, at least one rotational speed measuring unit is furthermore provided that determines a rotational speed of the drive unit, and wherein preferably a further rotational speed measuring unit is provided on one of the passively rotating elements that determines a rotational speed of the passively driven clamping units and/or support units, and wherein a controller is furthermore provided that is designed to determine a slippage of the workpiece from a rotational speed difference between the actively and passively driven elements. In addition to the contact force determination described above, with the aid of the rotational speed measurement it can also be determined whether there is sufficient frictional force/contact force of the drive unit, or whether the clamping force applied by the clamping units is sufficient to secure the workpiece sufficiently firmly in the workpiece holder. Thus, for example, the controller can be designed to control the drive unit and/or the clamping unit and/or the support unit in order to optimize the contact force or the clamping force and to minimize the slippage.

In particular, it is advantageous when the controller is furthermore designed to increase a contact force of the friction roller/of the friction wheel and/or a clamping force of the clamping units when a predetermined rotational speed difference is exceeded and/or to issue a notification about an increased slippage.

The clamping units, support units, and/or drive units of the workpiece holding device can be individually or jointly controllable.

In order that the clamping units, support units, and/or drive units do not themselves experience too large a thermal expansion/contraction, they are advantageously made from a temperature-resistant material, such as, for example, ceramic, polymer ceramic, aluminum silicate, stone, fireclay, or from special steel alloys.

According to a further preferred exemplary embodiment, the workpiece holding device furthermore includes a setting device that is designed to synchronously set the at least two clamping units in order to apply a predefined, essentially identical, radial and/or axial clamping force onto the workpiece. This makes it possible to apply a particularly uniform clamping force to the workpiece and thereby avoiding the occurrence of deformations due to the non-uniform application of force. In addition, the synchronous clamping of the clamping units eliminates the need to control the defined position of the workpiece. Due to the synchronous clamping of the clamping units, a clear position of the workpiece arises automatically.

According to one preferred exemplary embodiment, a single setting device is provided here that is designed to set all clamping units. Due to the single setting device that sets all clamping units, it can be ensured that an essentially identical force is exerted onto the workpiece by all clamping units.

Alternatively, a plurality of setting devices can also be provided that, for example, each set subgroups of clamping units, e.g., clamping units disposed opposite each other. Of course, it is of course also possible to provide for each clamping unit a separate setting device that is then controlled accordingly in order to obtain the synchronous clamping of the clamping units. However, the setting device/s that set/s all, or subgroups of, clamping units make/s possible a simple and cost-effective possibility to achieve a synchronous clamping with essentially equal clamping force.

Here it is preferred in particular when the setting device is designed to mechanically couple the clamping units. For this purpose the setting device can preferably include a belt, a chain, and/or a gear that can be brought into engagement mechanically with corresponding coupling elements provided on the clamping units. By movement of the setting device, for example, of the belt or of the gear, all clamping units are then clamped simultaneously and with the same force.

According to a further advantageous exemplary embodiment, the clamping units are movable both radially and tangentially, which is advantageous in particular with an essentially rotationally symmetric workpiece. Not only can thermal expansions/contractions thereby be accommodated during the thermal processing of the workpiece, but manufacturing tolerances, such as, for example, a certain ovality of the workpiece can also be compensated for during the clamping. Such an adapting is advantageous in particular with workpieces with closed curves, such as, for example, elements of a plain or rolling-element bearing, bearing rings, gears, bolts, sleeves, discs, etc.

In particular with annular workpieces, the clamping units are preferably displaceable radially, for example, by electric or hydraulic drive, and prior to the thermal treatment are moved toward the workpiece until the workpiece is firmly held between the clamping units. In order to be able to compensate for manufacturing tolerances, one or more of the clamping units can be supported such that it is eccentrically displaceable.

A further design provides that axially acting clamping units, in particular hold-down clamps that hold a workpiece radially, additionally can also track the thermal expansion/contraction of the workpiece in the axial direction. Here it is advantageous in particular when the movable element is formed as an eccentrically supported element since the eccentric supporting provides both a radial and a tangential movability of the element. In addition, the axially acting clamping units allow the workpiece to be able to held steady in its position even with light workpieces and strong magnetic fields of the induction coils.

A further aspect of the present invention relates to a method for the thermal treatment of a workpiece that is held in a workpiece holding device as described above, in which the method includes the following steps:

- inserting the workpiece into the workpiece holding device;
- clamping all clamping units until each clamping unit contacts the workpiece and abuts against the workpiece with a predeterminable, equally high, clamping force;
- activating the drive unit for the moving of the workpiece in the workpiece holding device, preferably with a predetermined rotational speed;
- starting the thermal treatment;
- actively or passively readjusting the clamping units and/or drive unit during the thermal treatment so that a predetermined position, clamping force, friction force, and/or contact force applies between clamping unit and/or drive unit during predeterminable time periods or the entire thermal treatment.

Deformations during the thermal treatment of the workpiece can thereby be avoided.

Further advantages and advantageous embodiments are specified in the description, the drawings, and the claims. Here in particular the combinations of features specified in the description and in the drawings are purely exemplary so that the features can also be present individually or combined in other ways.

In the following the invention is described in more detail using the exemplary embodiments depicted in the drawings. Here the exemplary embodiments and the combinations shown in the exemplary embodiments are purely exemplary and are not intended to define the scope of the invention. This scope is defined solely by the pending claims.

DETAILED DESCRIPTION

In the following, identical or functionally equivalent elements are designated by the same reference numbers.

Figure 1:
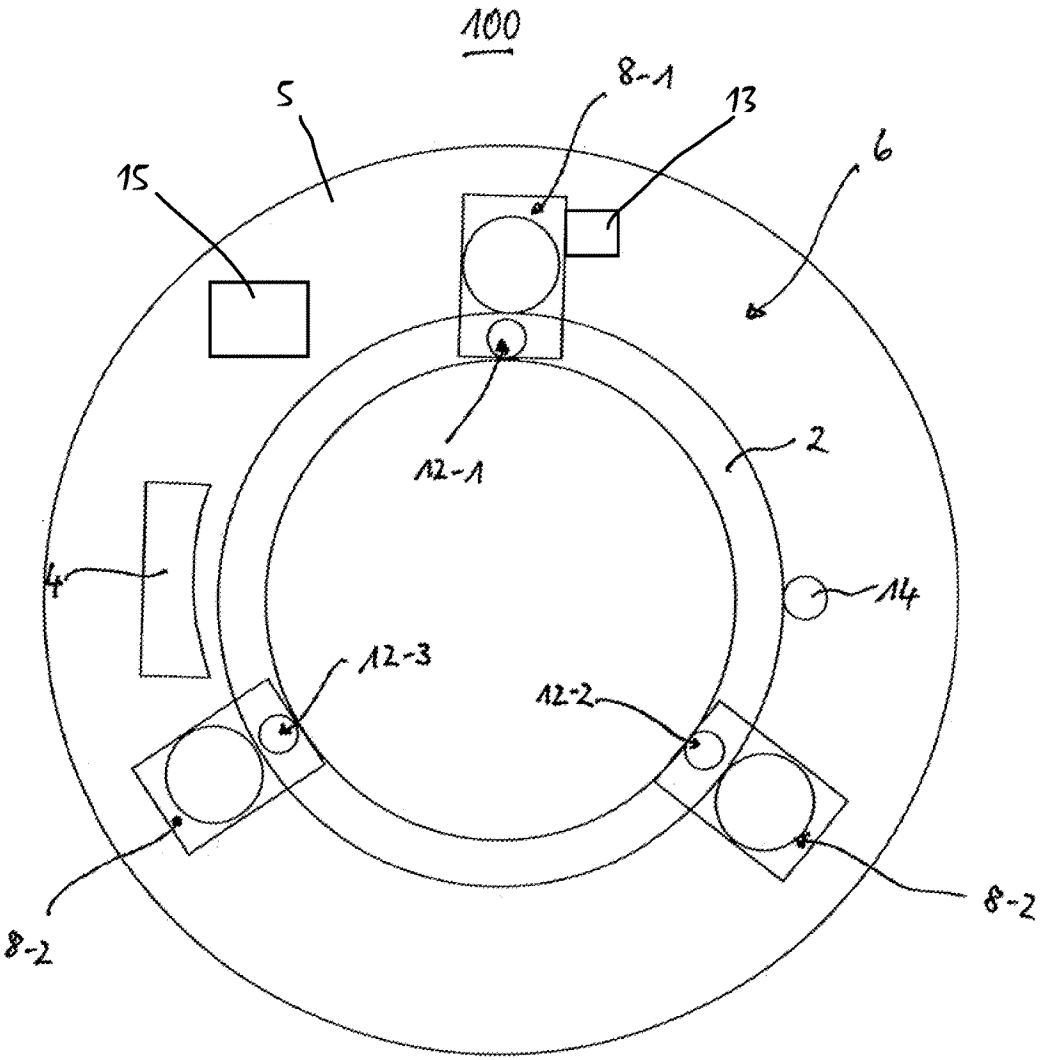
FIG. 1 is a schematic depiction of an induction hardening system with a workpiece holding device according to a preferred exemplary embodiment of the present disclosure.

FIG. 1 schematically shows a plan view of an induction hardening system 100 that is designed to inductively harden a workpiece 2, e.g., a bearing ring, with the aid of an inductor 4. Here the induction hardening system 100 depicted in FIG. 1 is formed as a hardening system in which the inductor 4 always heats only one part of the workpiece 2 while the workpiece 2 is moved past the inductor 4. For this purpose the workpiece 2 is clamped into a main body 5 of a workpiece holding device 6 and moved along the inductor 4. The workpiece holding device 6 has clamping units 8-1, 8-2, 8-3 for holding the workpiece 2, which are designed to hold the workpiece 2.

Furthermore, FIG. 1 shows that in the exemplary embodiments depicted, the workpiece 2 lies against three support units 12-1, 12-2, 12-3.

Now instead of, as in the prior art, rotating the entire system 6 in order to move the workpiece 2 along the inductor 4, a drive unit 14 is now furthermore provided that is designed to rotate only the workpiece 2. Of course, more than one drive unit 14 can also be present.

The drive unit 14 can be, for example, a friction wheel or a friction roller that acts directly on the workpiece 2 and sets it in rotation. Instead of a separate drive device 14 as depicted in FIG. 1, one of the clamping units 8 and/or of the support units 12 can also be configured as drive unit 14. Thus, for example, the clamping unit 8-1 can be configured simultaneously as a friction wheel or a friction roller that in turn acts directly on the workpiece 2 and sets it in rotation.

The clamping units 8, the support units 12, and/or the drive unit 14 can be moved radially, axially, circumferentially and/or tangentially in order to optimally abut against the workpiece 2. Furthermore, on one or more of the units 8, 12, 14 it is possible to attach one or more measuring devices 13 that are configured to measure a contact force and/or clamping force and/or friction force between the clamping units 8 and/or the support units 12 and/or the drive unit 14 and the workpiece 2. Furthermore, a controller 15 can also be provided that interacts with the units 8, 12 and 14 such that the units 8, 12, 14 interact with the workpiece 2 with a predetermined contact force, clamping force, and/or friction force.

Figure 2:
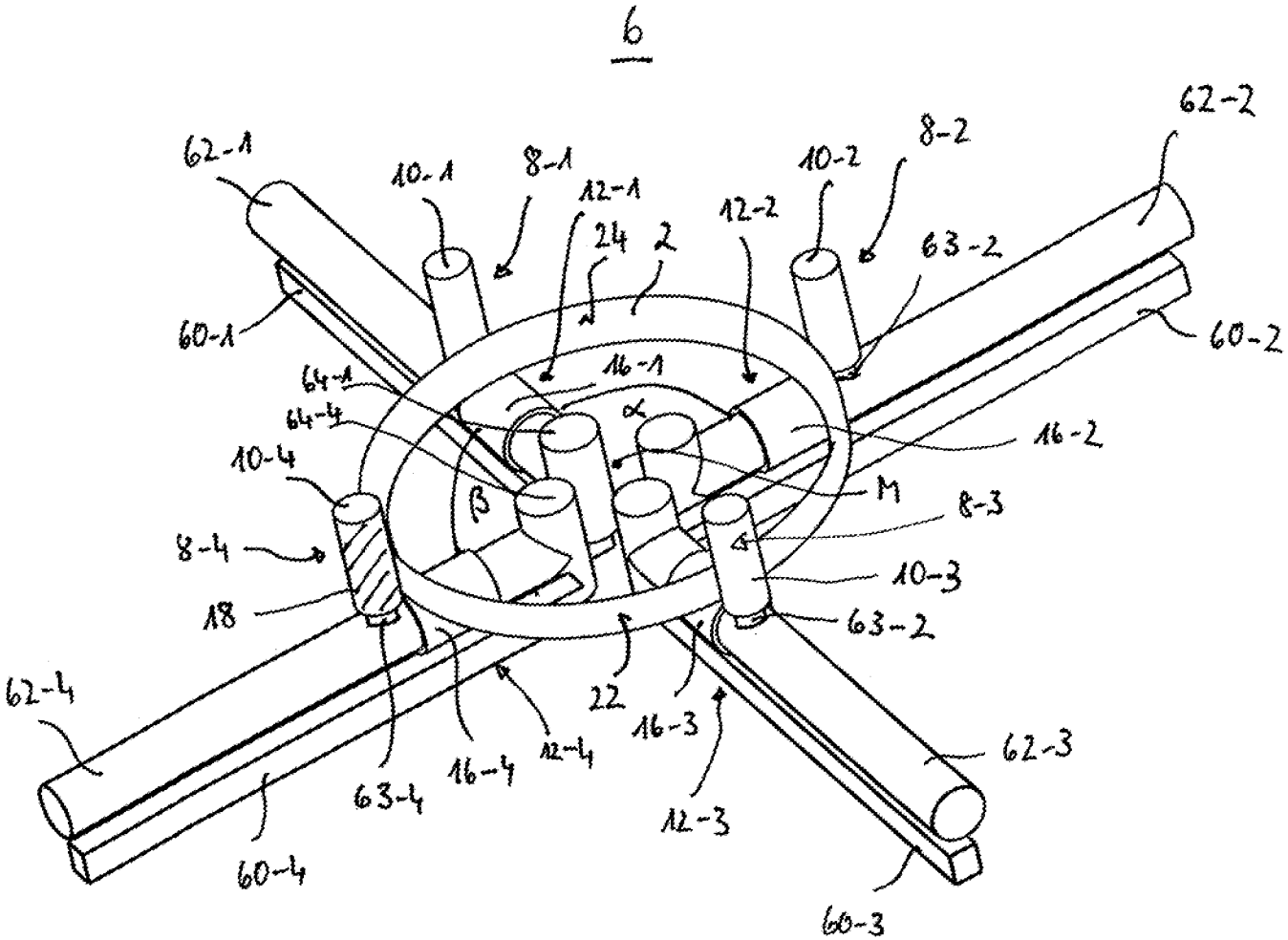
FIG. 2 is a schematic depiction of a workpiece holding device according to a preferred exemplary embodiment of the present disclosure.

FIG. 2 shows a schematic-perspective view of a first preferred exemplary of a workpiece holding device 6 that can be used in an induction hardening system 100, as schematically depicted in FIG. 1. In the exemplary embodiment depicted, the workpiece holding device 6 comprises four carriers 60-1, 60-2, 60-3, 60-4 that each carry rod-shaped, in particular cylindrical, shafts 62-1, 62-2, 62-3, 62-4. Here the carriers 60 and the shafts 62 can also be configured as one-piece integral elements. The shafts 62 and the carriers 60 in turn are rotatably (pivotably) attached to bearing assemblies 64 so that the carriers 60 extend offset radially outward from a rotational center M, wherein the rotational center M is determined by the rotation of the workpiece 2 in the workpiece holding device 6.

Furthermore, it can be seen from FIG. 2 that in the region in which the workpiece 2 lies against the carrier 60, support elements 16-1, 16-2, 16-3, 16-4 are provided that in the exemplary embodiment depicted are configured as cylindrical sleeves that are rotatably disposed on the shafts 62. Due to rotatability of the support elements 16, the workpiece 2 can easily be set into rotation. For this purpose one of the rotatable support elements 16 can be actively driven, that is, set in rotation, whereby the workpiece 2 is set in motion due to the friction between the support element and the workpiece 2.

Of course, more support elements 16, or all support elements 16, can also be actively driven.

Furthermore, FIG. 2 shows that on the carriers 60, and in particular on the shafts 62, clamping units 8-1, 8-2, 8-3, 8-4 are provided in the form of clamping elements 10-1, 10-2, 10-3, 10-4, that are designed to secure the workpiece 2 in its position. For this purpose, the clamping devices 8 can be set, for example, radially against the carriers 60 or against the shaft 62 until they contact the workpiece 2 and secure it in its position.

As depicted in FIG. 2, the clamping units 8 include clamping elements 10 in the form of clamping cylinders 10. The clamping elements or clamping cylinders 10 can be configured as sleeves releasably, and preferably rotatably, slipped onto hubs 63. Here it is advantageous in particular when the clamping element 10 is configured to be radially displaceable, together with its hub 63, along the carrier 60 or the shaft 62, in order to be adapted to different workpieces, or in order, for example, to exert a clamping force on a radial inner surface 24 of the workpiece 2 instead of the clamping force depicted here on a radial outer surface 22 of the workpiece 2.

Figure 6:
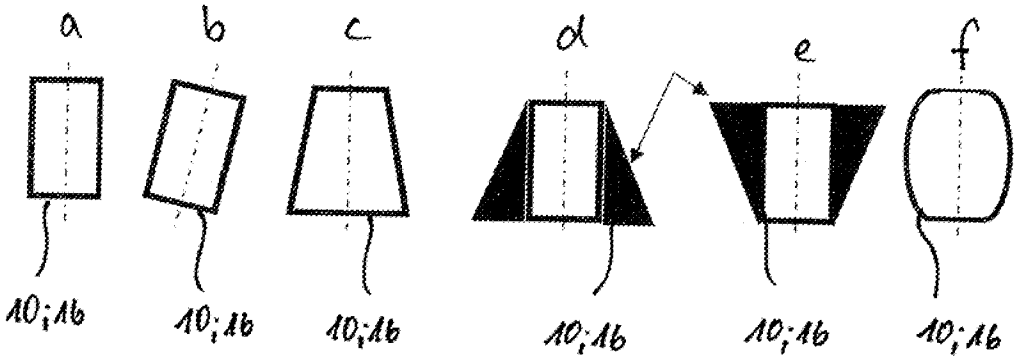
FIGS. 6*a*-6*f* are schematic depictions of various exemplary embodiments of clamping elements usable with the workpiece holding devices of the disclosed embodiments of the present disclosure.

Here it is preferred in particular when the clamping elements 10, as depicted in FIG. 6, are configured as slide-on sleeves. Here the slide-on sleeve 10 can have a cylindrical (FIGS. 6*a*, 6*b*), conical (FIG. 6*c*-6*e*), convex (FIG. 6*f*) and/or spherical shape. The exact shape can depend on a plurality of factors. On one hand, the shape can be adapted to the shape or curvature of the radially inner or outer surface 22; 24 of the workpiece 2. Here it is preferred in particular that the slide-on sleeve contacts the workpiece 2 along a line, wherein the line is oriented parallel to the rotational axis. This makes possible a pure rotational movement between rotating element and workpiece without sliding movement. However, it is equally possible to select the shape based on a minimal contact but sufficient clamping force. The shape can also be selected based on rotation considerations. Furthermore, it is possible that the clamping units 8-1-8-4 include differently designed slide-on sleeves.

According to a further preferred exemplary embodiment, the hub 63 can also be set angularly with the aid of a setting device (not depicted), as also schematically indicated in FIG. 6*b*. This also makes possible a particularly good adapting of the rotating elements to the geometry of the workpiece. Thus, with the aid of the adjusting device, it is possible, for example, to use a cylindrical rotatable element also for obliquely extending radial surfaces and still guide the rotating element along the workpiece with linear contact. Alternatively, a conical sleeve could also be used here as depicted in FIGS. 6*c* to 6*d*.

Alternatively or additionally, one of the clamping units, for example, 8-3, can function as the drive unit 14, and then carries a friction roller 18 instead of a clamping cylinder 10-3, which frictionally abuts against the workpiece 2 and is actively set in rotation in order to rotate the workpiece 2. The driven clamping roller/friction roller 18 can be present alternatively or in addition to a driven support element 16. The friction roller 18 can also have a cylindrical, conical, convex, toroidal, and/or spherical shape, as depicted in FIG. 6.

In addition to the radial adjustability of the clamping units 8, it can also be provided that the carriers 60 are themselves movable and can be brought from an open position in which the workpiece 2 can be placed in the workpiece holding device 6 and against the support elements 16, into a closed position in which the workpiece is clamped in the clamping units 8, and they abut against the workpiece 2 with clamping force. For this purpose the carriers 60 are rotatably supported on the carrier bearing assemblies 64-1, 64-2, 64-3, 64-4. The carrier bearing assemblies 64 are in turn disposed eccentrically with respect to the rotational center M of the workpiece.

Figure 3:
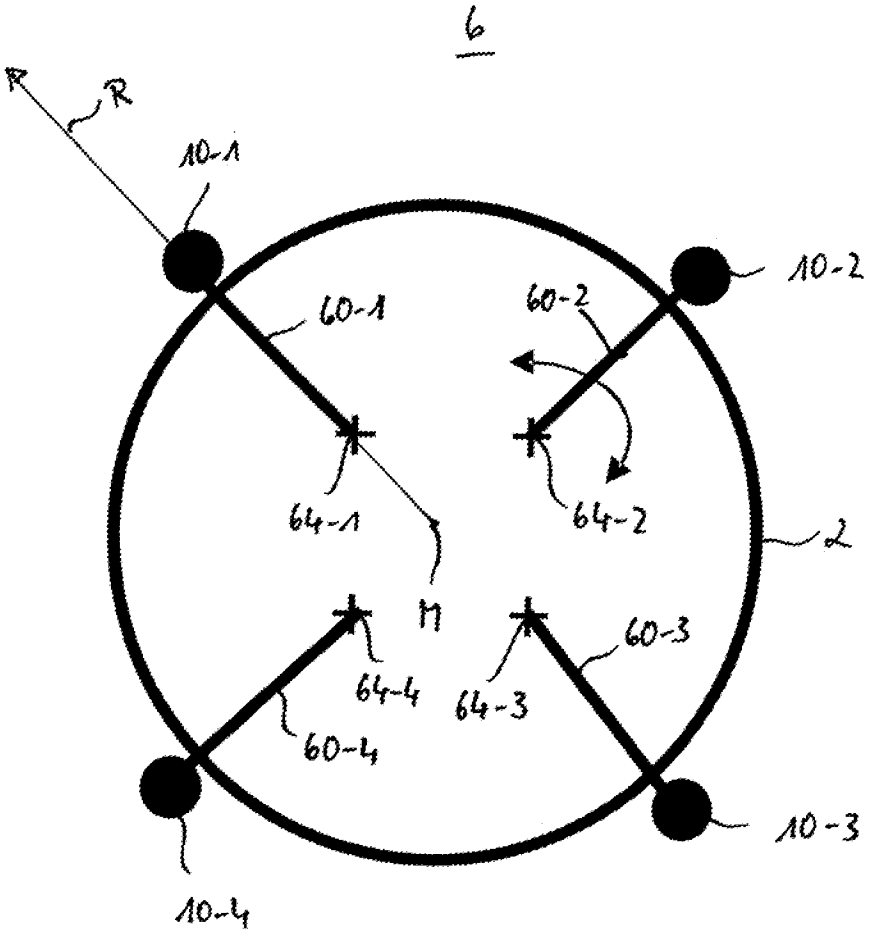
FIG. 3 is a schematic depiction of a clamping possibility of clamping units in the workpiece holding device according to FIG. 2.

FIG. 3 schematically shows the design from FIG. 2, and the clamping possibility corresponds to that in the exemplary embodiment depicted in FIG. 2. Since, as mentioned above, the carriers 60 are not supported in the center of rotation M, but rather are eccentrically supported at points 64-1, 64-2, 64-3 and 64-4, the distance between the clamping elements 10 and the workpiece 2 can be maximized or minimized depending on the position of the carriers. Thus, for example, in a so-called zero position, the distance between clamping unit 8 and workpiece 2 can be maximized so that the workpiece 2 can be inserted into the workpiece holding device 6 without it contacting the clamping unit. In the exemplary embodiment depicted, this is possible with an orientation of the carriers in the radius direction of the workpiece. That is, when the carrier is oriented precisely in the radius direction R of the workpiece 2 (see FIG. 3), the distance between workpiece 2 and clamping unit 8 is maximized. With an angular adjustment about the zero position (see arrow), the clamping unit 8 approaches the workpiece 2 until the clamping unit 8 abuts against the workpiece 2 and can exert a clamping force. This applies to the embodiment shown in FIG. 2 or 3 in which a radially inwardly directed clamping force is applied, and the clamping units 8 are disposed radially outside on the workpiece 2.

In contrast, if the workpiece is clamped with a radially outwardly directed clamping force, i.e., with a clamping of the workpiece with clamping units disposed radially inside the workpiece, the clamping is increased when the carrier is rotated toward the orientation in the radius direction. In this case, a zero position is given over a certain maximum angular displacement, in particular at 45°, of the carrier with respect to the radius orientation.

Figure 4:
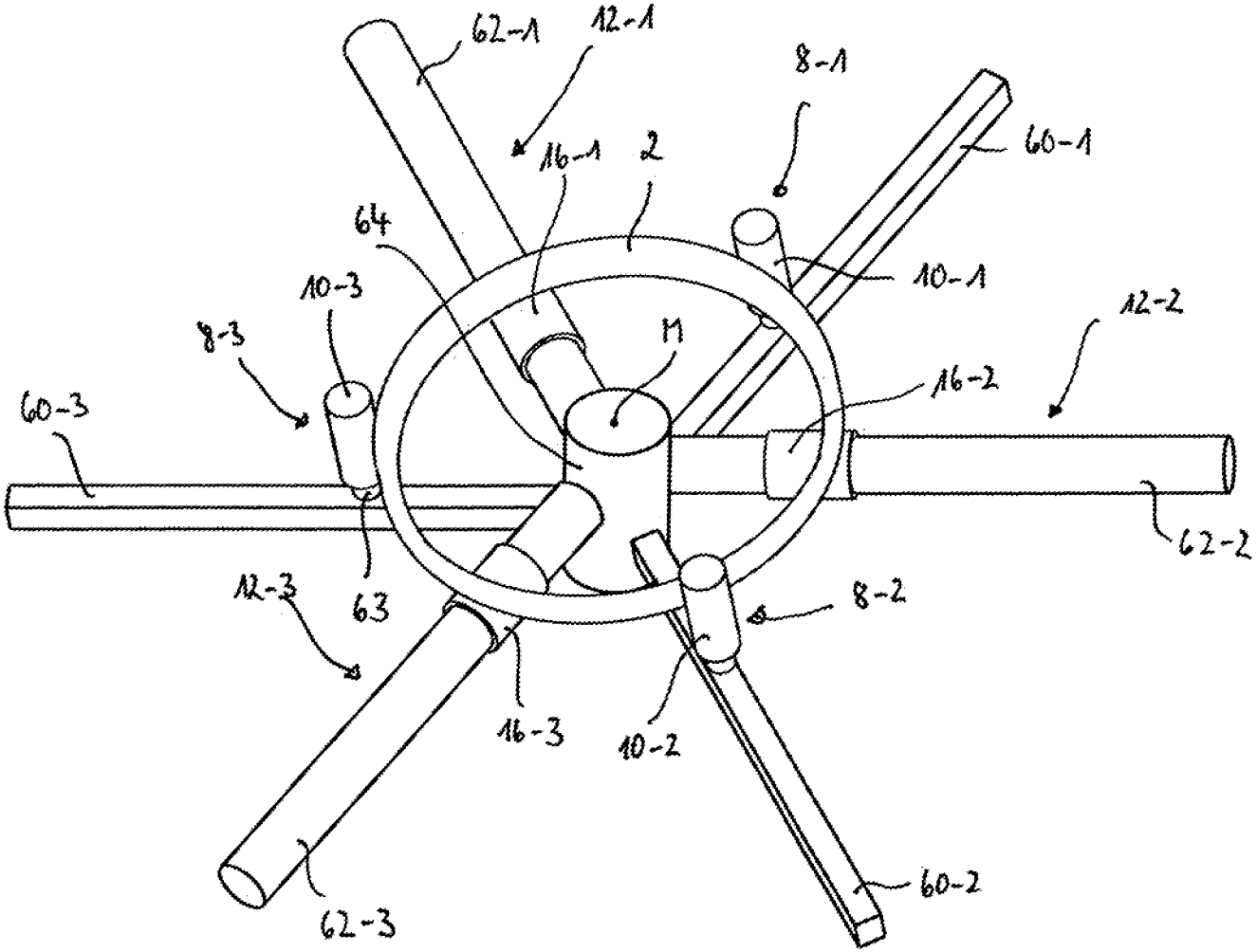
FIG. 4 is a schematic depiction of a workpiece holding device according to a further preferred exemplary embodiment of the present disclosure.

FIG. 4 shows another preferred exemplary embodiment, in which the support units 12 and the clamping units 8 are attached on separate carriers 62 or 60. Here the workpiece 2 again lies against the support element 16 and is secured in its position by clamping elements 10. In addition, FIG. 4 shows that three support units 12 or 3 clamping units 8 are provided. The drive unit 14 can in turn be integrated into the support elements 16 or into the clamping elements 10 8 in order to set the workpiece 2 in rotation.

The clamping units 8 can in turn also include slidable-on clamping cylinders 10-1, 10-2 and 10-3, that can be moved radially in order to exert a clamping on the workpiece 2 and to hold it in position. These can also have various shapes, as depicted in FIG. 6.

The rotatable support elements 16 of the support units 12 can also be formed as exchangeable sleeves with the shapes shown by way of example in FIG. 6. The can thereby on the one hand ensure a low-friction and tilt-free supporting of the workpiece and simultaneously ensure a particularly good accessibility to the surfaces to be treated. On the other hand, the flexible design also allows adaptation to the shape of the workpiece itself via the exchangeable sleeves.

Figure 5:
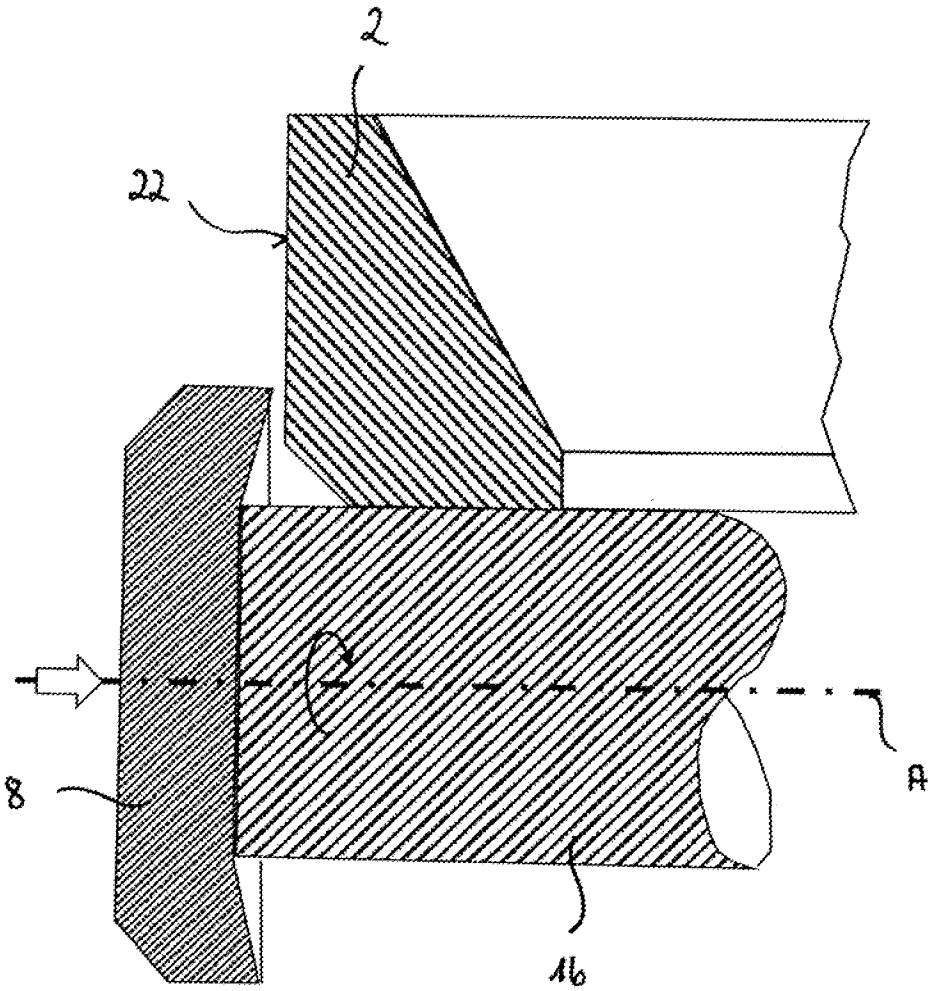
FIG. 5 is a schematic depiction of a workpiece holding device according to a further preferred exemplary embodiment of the present disclosure.

FIG. 5 shows a further preferred exemplary embodiment in which the rotatable support element 16 and a clamping unit 8 formed as friction wheel 18 are present as a combined element. Here the friction wheel 18 abuts against the radial outer surface 22 of the workpiece and can thus simultaneously exert a clamping force on the workpiece 2. Thus the friction wheel 18 also assumes the function of the clamping unit 8. With rotating of the support element 16 about its longitudinal axis A, the friction wheel 18 is simultaneously rotated. Due to the abutment (friction) of the friction wheel 18 against the outer surface 22 of the workpiece, the rotational movement of the support element 16 is also transmitted via the friction wheel 18 onto the workpiece 2 so that the workpiece 2 is also rotated.

Figure 7:
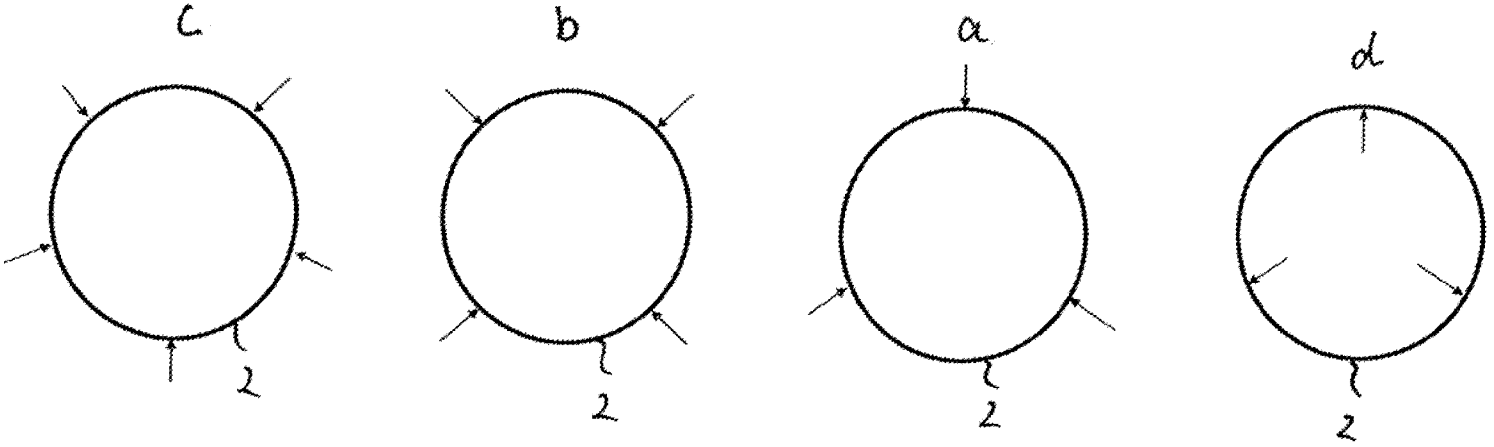
FIGS. 7*a*-7*d* are schematic depictions of various clamping possibilities.

As schematically depicted by arrows in FIG. 7, in order to apply a balanced-as-possible clamping by the clamping units 8 onto the workpiece 2, at least two application points, preferably three application points (see FIG. 7*a*) are provided for the clamping force. However, more than three application points, for example, four (see FIG. 7*b*) or five (see FIG. 7*c*) application points, can also be present. As can be seen in particular from FIGS. 7*a* and 7*d*, the application points can be provided both from radially outward and radially inward, wherein a clamping from radially inside or from radially outside can also be chosen in a manner depending on the surfaces to be hardened. Thus, for example, in the case of a bearing inner ring in which the radial outer surface is to be hardened, it is preferred to provide a clamping from radially inside since this surface is facing away from the surface to be heated and then the clamping elements are not also heated. Similarly, with an outer ring to be hardened (see FIGS. 7*a-c*) it is advantageous to allow the clamping elements to grip from radially outside, i.e., also on the surface not to be hardened.

Figure 8:
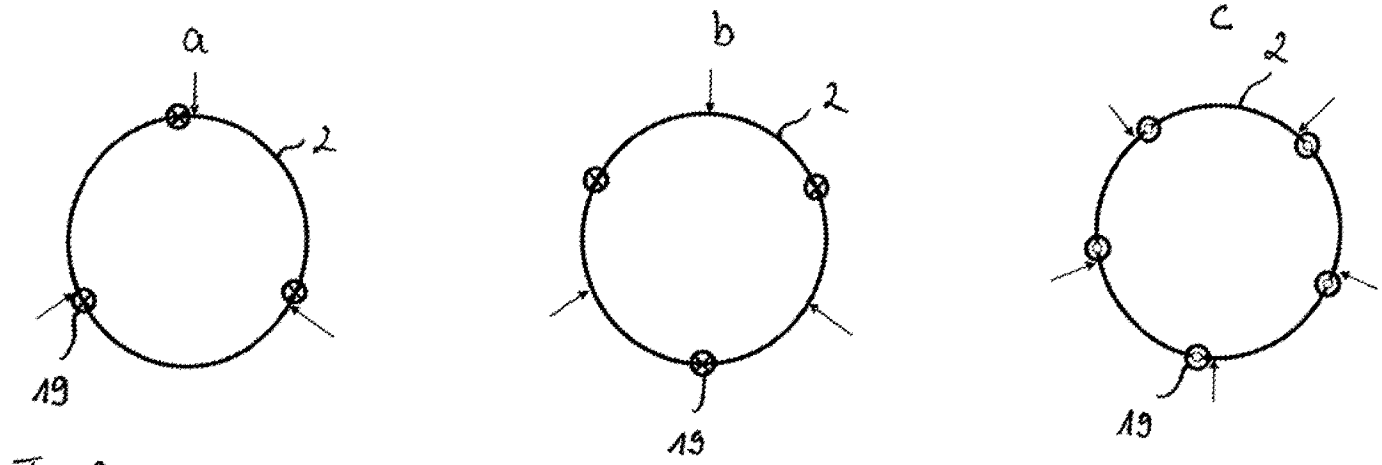
FIGS. 8*a*-8*c* is schematic depictions of various further clamping possibilities.

In addition to the radial clamping units 8 as depicted in FIGS. 1 to 4 and 6, so-called hold-down clamps 19 (see FIG. 8) can also be used that apply an axial clamping onto the workpiece 2. The axial clamping elements 19 can simultaneously also be configured as drive units and, for example, frictionally abut against the workpiece so that it can be set in motion. These hold-down clamps 19 are used in particular with light workpieces and high magnetic field strengths of the inductor 4 in order to hold the workpiece in the workpiece holding device 100 securely and in a positionally accurate manner. Exactly like the support units 12, the axial hold-down clamps 19 can be combined with the elements of the radial clamping, as depicted in the Figures of FIG. 8, and can be provided in the same location (see FIGS. 8*a*, 8*c*) or at different locations (see FIG. 8*b*). Of course, it is also possible to provide a different number of axial clamping elements and radial clamping elements.

Figure 9:
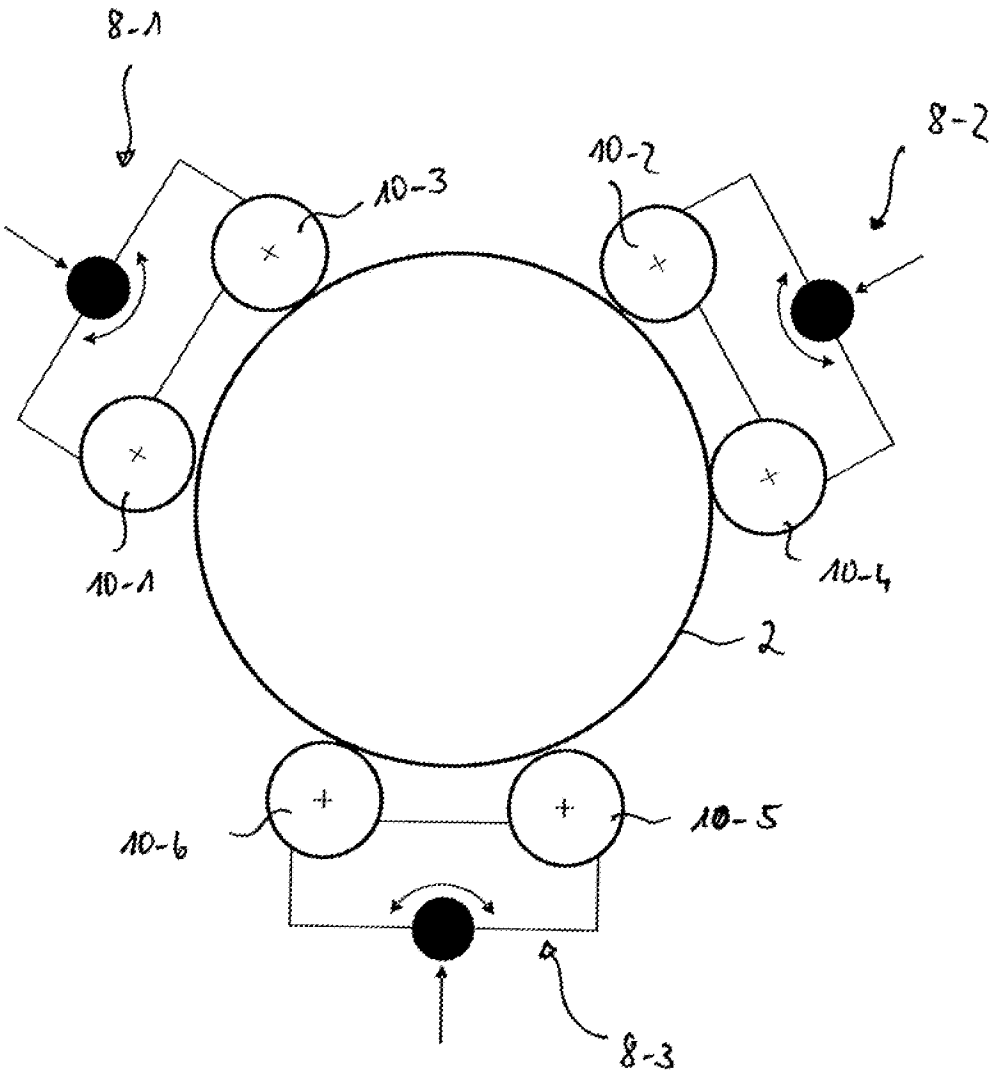
FIG. 9 is a schematic depiction of a workpiece holding device according to a further preferred exemplary embodiment of the present disclosure.
Figure 10:
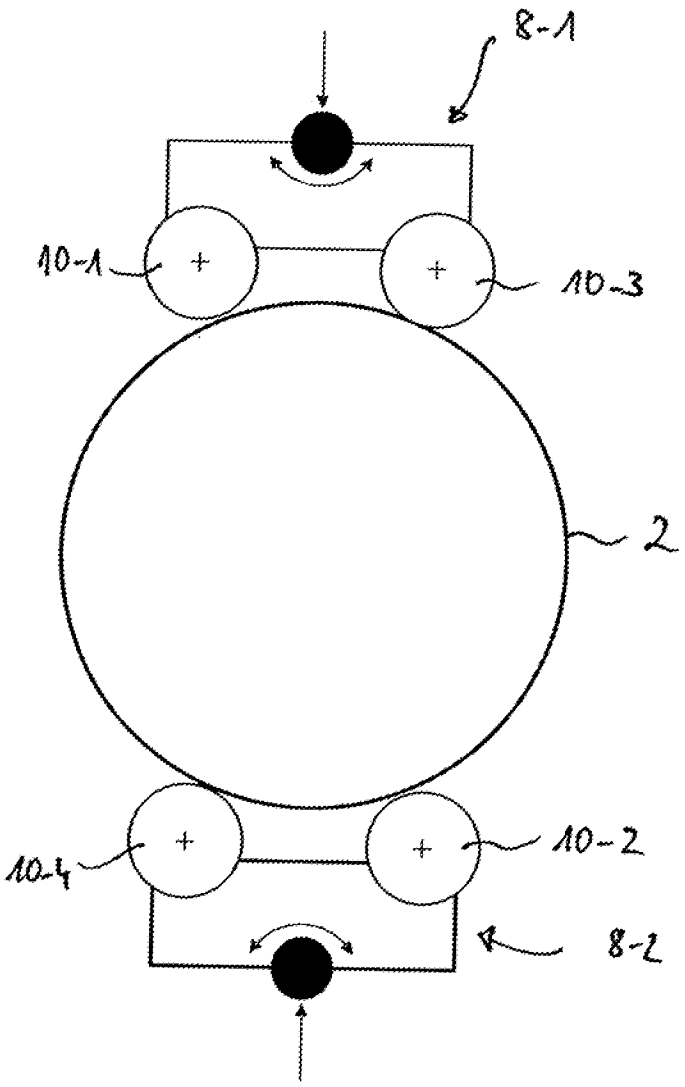
FIG. 10 is a schematic depiction of a workpiece holding device according to a further preferred exemplary embodiment of the present disclosure.

Instead of only one clamping cylinder each, as depicted in FIGS. 1-8, the clamping units can also include double clamping cylinders as depicted in FIGS. 9 and 10. Here also, one or more of the clamping cylinders 10 can simultaneously be configured as a drive 14, or a separate drive can be possible. The embodiment using such clamping elements leads to a particularly low-deformation clamping with ovality, out-of-roundness, triangularity, or other shape deviations of the workpiece.

Figure 11B:
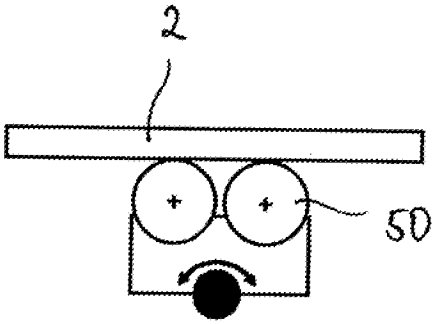
FIGS. 11*a* and 11*b* are schematic depictions of a workpiece holding device according to a further preferred exemplary embodiment of the present disclosure.
Figure 11A:
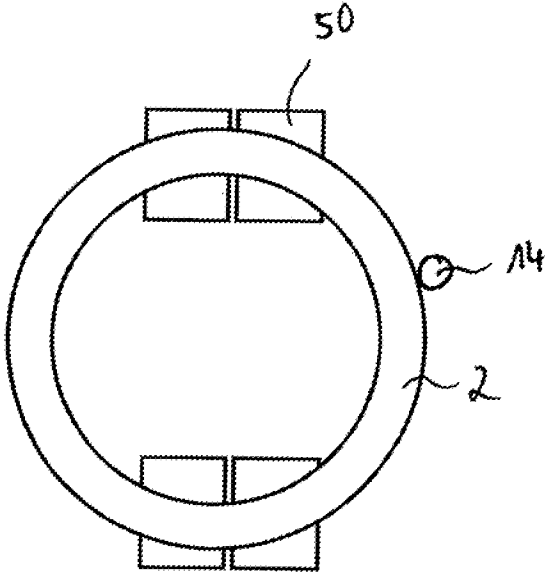

FIG. 11 shows two different views of a further exemplary embodiment in plan view (FIG. 11*a*) and side view (FIG. 11*b*), wherein the clamping unit 8 can include so-called slide shoes 50 against which the workpiece 2 is supportively guided. The slide shoes 50 can preferably abut against an axial end surface of the workpiece 2, whereby rings that are twisted or wavy in themselves can also be supported. The slide shoes 50 can be embodied flat. However, it is also possible to provide a roller bearing, as depicted in particular in the side view. It is advantageous in particular with a supporting of an inherently wavy workpiece on slide shoes 50, as depicted in FIG. 11, to provide a separate drive unit 14, as depicted in FIG. 11*a*.

In general, the clamping units do not also need to be disposed equidistantly around the workpiece, but rather it is possible to choose different spacings of the clamping units. It is also possible that the clamping device 8 is not itself provided as a drive unit, but rather, for example, a separate drive unit 14 (see FIGS. 1, 11) is provided, or one of the support units 12 serves as drive unit.

Overall, the flexible design of the clamping units and support units makes possible a particularly good adapting of the workpiece holding device to various shapes of the workpieces. An individually adjustable device can thereby be provided, which, however, is universally usable for a variety of workpieces.

A controller as disclosed herein may be a programmable hardware component that can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved workpiece holding device.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

100 Hardening system
2 Workpiece
4 Induction coil
5 Main body
6 Workpiece holding device
8 Clamping unit
10 Clamping element
12 Support unit
13 Measuring device
14 Drive unit
15 Controller
16 Support element
18 Friction roller
19 Hold-down clamp
22 Radially outer side of the workpiece
24 Radially inner side of the workpiece
50 Slide shoes
60 Carrier
62 Rod-shaped shaft
63 Hub
64 Bearing assembly

What is claimed is:

1. A workpiece holding device for holding a workpiece having a substantially radial inner surface and a substantially radial outer surface in a heat treatment system while the workpiece undergoes a thermal expansion and/or contraction, the workpiece holding device comprising:

at least two clamping units configured to apply a radial clamping force to the workpiece to hold the workpiece in the workpiece holding device in a predefined position, each of the at least two clamping units including a clamping element configured to abut against the radially inner surface and/or against the radially outer surface of the workpiece and to apply a radial clamping force to the workpiece and a drive unit configured to rotate the workpiece held in the workpiece holding device, the drive unit comprising a friction wheel or a friction roller configured to abut against the workpiece such that a rotation of the friction wheel or the friction roller is frictionally imparted to the workpiece to move a fixed point on the workpiece relative to the at least two clamping units.

2. The workpiece holding device according to claim 1, wherein the clamping element is configured as a slide shoe having a contact surface abutting against the radially inner surface and/or radially outer surface, the contact surface having a curvature adapted to a curvature of the radially inner surface and/or the radially outer surface.

3. A method comprising:

providing a workpiece holding device according to claim 1, mounting the workpiece in the workpiece holding device, moving the at least two clamping units into contact with the workpiece to clamp the workpiece with a predetermined clamping force, rotating the workpiece in the workpiece holding device, performing a thermal treatment on at least a portion of the workpiece in the workpiece holding device, and while performing the thermal treatment, adjusting the at least two clamping units to maintain the predetermined clamping force.

4. A system comprising:

a workpiece holding device according to claim 1, and the workpiece, wherein the at least two clamping units apply the radial clamping force to the workpiece to hold the workpiece in the workpiece holding device in the predefined position, and wherein the friction wheel or the friction roller abuts against the workpiece.

5. A workpiece holding device for holding a workpiece having a substantially radial inner surface and a substantially radial outer surface in a heat treatment system while the workpiece undergoes a thermal expansion and/or contraction, the workpiece holding device comprising: at least two clamping units configured to apply a radial clamping force to the workpiece to hold the workpiece in the workpiece holding device in a predefined position, each of the at least two clamping units including a clamping element configured to abut against the radially inner surface and/or against the radially outer surface of the workpiece and to apply a radial clamping force to the workpiece, wherein each of the clamping elements has a rotational axis, and wherein each of the clamping elements is configured to abut against the workpiece, and wherein the rotational axis of the clamping element is substantially parallel to an axis of rotation of the workpiece.

6. The workpiece holding device according to claim 5, wherein the rotatable clamping element has a cylindrical, conical, convex, and/or spherical shape.

7. The workpiece holding device according to claim 5, wherein the rotatable clamping element is configured to make line contact with the workpiece along a line parallel to the rotational axis.

8. The workpiece holding device according to claim 5, wherein the rotatable clamping element comprises a slide-on sleeve releasably mounted on a journal of the clamping unit.

9. The workpiece holding device according to claim 5, wherein the clamping unit is configured to set an angle between the rotational axis of the rotatable clamping element and a rotational axis of the workpiece.

10. The workpiece holding device according to claim 5, including at least three support units configured to axially support the workpiece, the support units each including at least one rotatable support element against which workpiece lies.

11. The workpiece holding device according to claim 10, wherein the rotatable support element is a sleeve releasably attached to the support unit and having a cylindrical, conical, spherical, and/or toroidal outer surface.

12. The workpiece holding device according to claim 10, wherein at least one of the clamping units and one of the support units are disposed on a same carrier, wherein the rotatable clamping element and support elements of the clamping unit and support unit disposed on the common carrier are configured as a combined rotatable element.

13. The workpiece holding device according to claim 10, wherein the rotatable clamping element of one of the at least two clamping units is actively driven to frictionally impart rotation to the workpiece or at least one of the rotatable support elements is actively driven to frictionally impart rotation to the workpiece.

14. The workpiece holding device according to claim 5, wherein the clamping element is configured to abut against the workpiece with a predetermined contact force and to maintain the predetermined contact force while the workpiece thermally expands and contracts.

15. The workpiece holding device according to claim 14 including a controller configured to control the contact force.

16. The workpiece holding device according to claim 5, wherein at least one clamping unit includes a force measuring device configured to measure a clamping force of the clamping unit on the workpiece, and wherein the force measuring device is configured to communicate with the controller.

17. The workpiece holding device according to claim 5, wherein the clamping element has an outer surface configured to contact the workpiece while the workpiece rotates, and wherein the rotational axis of the clamping element is adjustable.

18. A system comprising:

a workpiece holding device according to claim 4, and the workpiece, wherein the at least two clamping units apply the radial clamping force to the workpiece to hold the workpiece in the workpiece holding device in the predefined position.

* * * * *